US008201344B2

(12) United States Patent
Sawabe et al.

(10) Patent No.: US 8,201,344 B2
(45) Date of Patent: Jun. 19, 2012

(54) HAND DRYING APPARATUS

(75) Inventors: Kenji Sawabe, Chiyoda-ku (JP); Manabu Fukano, Chiyoda-ku (JP); Shigeki Nishimura, Chiyoda-ku (JP); Yasuyuki Itoigawa, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 407 days.

(21) Appl. No.: 12/601,633

(22) PCT Filed: Jun. 18, 2008

(86) PCT No.: PCT/JP2008/061139
§ 371 (c)(1),
(2), (4) Date: Nov. 24, 2009

(87) PCT Pub. No.: WO2009/011198
PCT Pub. Date: Jan. 22, 2009

(65) Prior Publication Data

US 2010/0192399 A1 Aug. 5, 2010

(30) Foreign Application Priority Data

Jul. 18, 2007 (JP) ..... 2007-187058
Aug. 7, 2007 (JP) ..... 2007-205855
Aug. 8, 2007 (JP) ..... 2007-207074
Oct. 5, 2007 (JP) ..... 2007-262186

(51) Int. Cl.
*A47K 10/00* (2006.01)

(52) U.S. Cl. ..... 34/95; 34/202; 34/218; 239/329; 239/418; D28/54.1; 219/521; 132/73.5; 392/380

(58) Field of Classification Search ..... 31/90, 95, 31/202, 210, 218, 242, 105; 392/380; 239/329, 239/418; 132/73.5; 219/521; D28/54.1
See application file for complete search history.

(56) References Cited

U.S. PATENT DOCUMENTS 4,754,769 A * 7/1988 Flynn ..... 132/73.5
5,459,944 A * 10/1995 Tatsutani et al. ..... 34/202
(Continued)

FOREIGN PATENT DOCUMENTS

JP 62-70887 U 5/1987
(Continued)

OTHER PUBLICATIONS

Office Action (Notice of Rejection) dated Oct. 25, 2011, issued in the corresponding Japanese Patent Application No. 2009-523578, and a Partial English Translation thereof.

(Continued)

*Primary Examiner* — Stephen M. Gravini
(74) *Attorney, Agent, or Firm* — Buchanan Ingersoll & Rooney PC

(57) ABSTRACT

A hand drying apparatus includes a high-pressure airflow generator that takes air through an air inlet and generates a high-pressure airflow, a main body casing, a first air path that is protruded from the main body casing, and a nozzle that is located in a position ahead of the main body casing in a direction of the first air path. The main body casing includes a main-body air inlet through which outside air is taken and a second air path that causes air from the main-body air inlet to flow upward and then downward to a level where the air inlet of the high-pressure airflow generator is located.

31 Claims, 12 Drawing Sheets

U.S. PATENT DOCUMENTS

| | | | | |
|---|---|---|---|---|
| 6,038,786 | A * | 3/2000 | Aisenberg et al. | 34/267 |
| D548,399 | S * | 8/2007 | Nikaido et al. | D28/54.1 |
| 2008/0222910 | A1* | 9/2008 | Churchill et al. | 34/202 |
| 2008/0313918 | A1* | 12/2008 | Dyson et al. | 34/202 |
| 2009/0113748 | A1* | 5/2009 | Dyson et al. | 34/232 |
| 2010/0192399 | A1* | 8/2010 | Sawabe et al. | 34/95 |
| 2011/0271441 | A1* | 11/2011 | Bayley et al. | 4/638 |
| 2012/0017459 | A1* | 1/2012 | Kikuchi et al. | 34/202 |
| 2012/0017460 | A1* | 1/2012 | Kikuchi et al. | 34/202 |

FOREIGN PATENT DOCUMENTS

| | | | |
|---|---|---|---|
| JP | 2-134089 | U | 11/1990 |
| JP | 5-300847 | A | 11/1993 |
| JP | 6-319658 | A | 11/1994 |
| JP | 11-000283 | A | 1/1999 |
| JP | 11-113794 | A | 4/1999 |
| JP | 2000-178 | A | 1/2000 |
| JP | 2000-107073 | A | 4/2000 |
| JP | 2000-271039 | A | 10/2000 |
| JP | 2001-258786 | A | 9/2001 |
| JP | 2001-258789 | A | 9/2001 |
| JP | 2005-160874 | A | 6/2005 |
| JP | 2006-095246 | A | 4/2006 |
| JP | 2006-263152 | A | 10/2006 |
| JP | 2007-054670 | A | 3/2007 |

OTHER PUBLICATIONS

International Search Report of Application No. PCT/JP2008/061139 dated Sep. 16, 2008.

Written Opinion of the International Searching Authority of Application No. PCT/JP2008/061139 dated Sep. 16, 2008.

* cited by examiner

HAND DRYING APPARATUS

TECHNICAL FIELD

The present invention relates to a hand drying apparatus for mounting on a side of a washbowl of a washstand or a sink of a sink cabinet and that blows an air to user's wet hands after being washed thereby drying the hands in a sanitary manner.

BACKGROUND ART

In a conventional air dryer, a case main body including an air inlet is divided into an upper case and a lower case, and an electric fan is mounted in the upper case to take air from the outside through the air inlet and blow the air from an exhaust nozzle. The air inlet is arranged on the rear side of the case main body, and the exhaust nozzle is arranged on the front side of the upper case (for example, see Patent document 1).

Patent document 1: Japanese Patent Application Laid-open No. 2001-258786

DISCLOSURE OF INVENTION

Problem to be Solved by the Invention

However, in the conventional air dryer, a high-speed airflow from the exhaust nozzle is blown downward to the front side of a drying space in a lateral line direction. Therefore, it is necessary for a user to put the hands in and out of the drying space such that the hands cross the high-speed airflow at a substantially right angle thereby drying the hands.

However, because the drying space is not a closed space, the user does not always put the hands in and out of the drying space such that the hands cross the high-speed airflow at the substantially right angle. If the user puts the hands in and out of the drying space in a direction parallel to the lateral line of the high-speed airflow, it is difficult to blow water off the hands, resulting in a low drying efficiency. Moreover, the exhaust nozzle needs to have an appropriate size in the lateral direction (right and left direction) to perform the drying operation in a short time. This causes another problem that it is difficult to reduce the size of the air dryer.

In addition, the high-speed airflow blown from the exhaust nozzle hits the washbowl, or the like. Therefore, if the air dryer is used in a situation where water is kept in the washbowl, in a situation where water runs from the tap, or in a situation where the washbowl is wet, the high-speed airflow blown from the exhaust nozzle causes the water inside the washbowl to be splashed around. As a result, there is a problem that the water is splashed around a washstand, a washstand mirror, or a kitchen counter, which may make the user feel uncomfortable.

The present invention has been made to solve the above problems in the conventional air dryer and it is the first object of the present invention to provide a hand drying apparatus that provides a drying space with a high degree of freedom in directions in which the user puts the hands in and out of the drying space, and provides a high drying efficiency. Moreover, it is the second object of the present invention to provide a hand drying apparatus that prevents water from being splashed around, even if the hand drying apparatus mounted in the washstand or the kitchen counter is used in a situation where water is kept in the washbowl or the sink or in a situation where water runs from the tap, thereby preventing the user from feeling uncomfortable.

Means for Solving Problem

To solve the above problems and to achieve the object, a hand drying apparatus according to the present invention includes: a high-pressure airflow generator that takes air through an air inlet arranged at a lower portion of the high-pressure airflow generator and generates a high-pressure airflow; a main body casing in which the high-pressure airflow generator is accommodated; a first air path that is protruded from the main body casing and that allows passage of air from the high-pressure airflow generator; and a nozzle that is located in a position ahead of the main body casing in a direction of the first air path and that blows air from the first air path toward a front portion and side portions of a drying space under the first air path. The main body casing includes a main-body air inlet through which outside air is taken and a second air path that causes air from the main-body air inlet to flow upward and then downward to a level where the air inlet of the high-pressure airflow generator is located.

Effect of the Invention

A hand drying apparatus according to the present invention produces an effect that it is possible to provide a drying space with a high degree of freedom in directions in which the user puts the hands in and out of the drying space and a high drying efficiency.

EXPLANATIONS OF LETTERS OR NUMERALS

Figure 1:
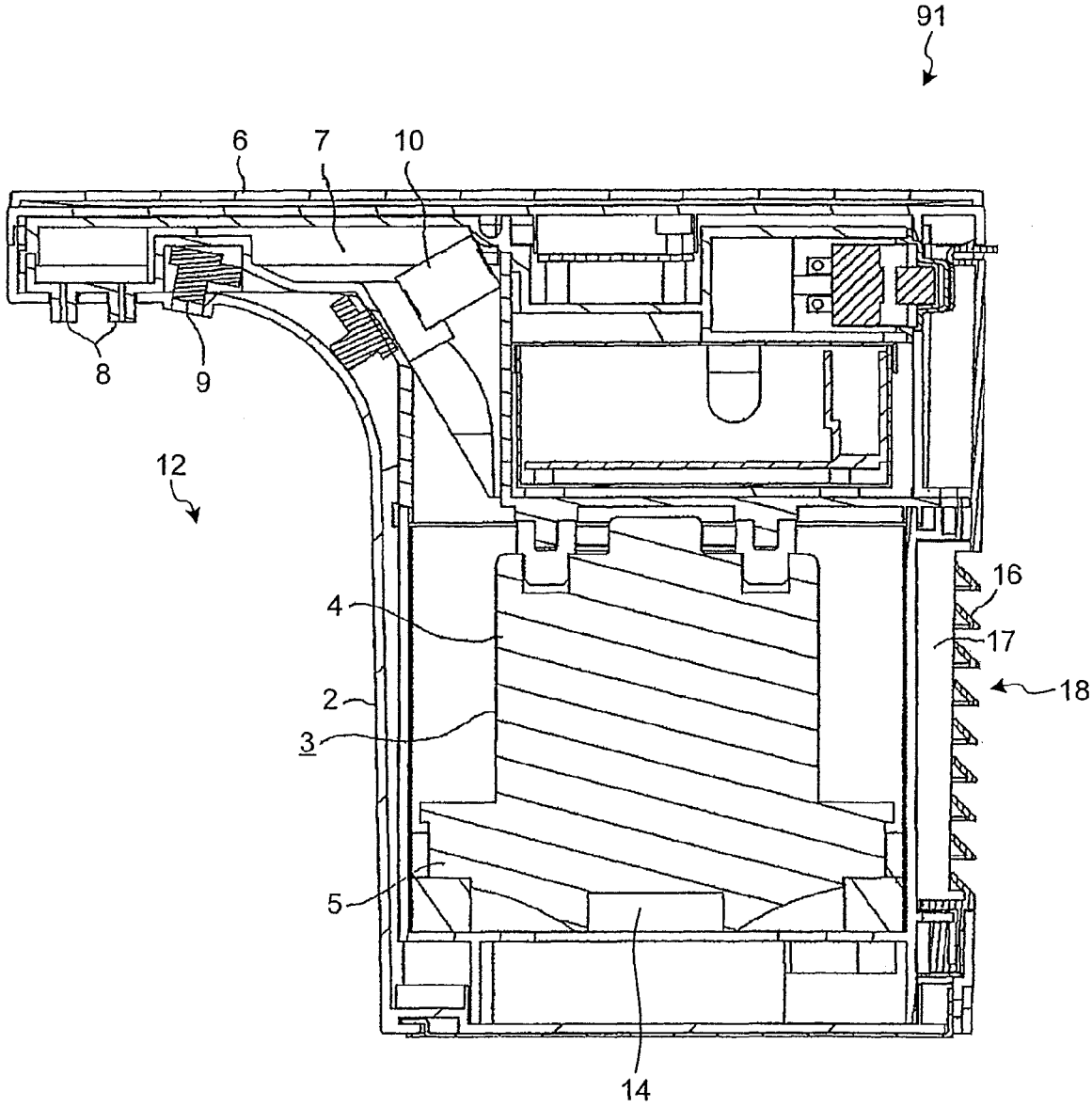
FIG. 1 is a vertical cross section of a hand drying apparatus according to a first embodiment of the present invention.

1 washbowl
1*a* drain
1*b* washstand
2 main body casing
3 high-pressure airflow generator
4 motor
5 turbofan
6 protruded portion (protruded structure)
7 air path
8 nozzle
9 sensor
10 heater
11 blowing port
12 drying space (hand insertion space)
13 stand
14 air inlet
15 trap
15*a* bottom plate
15*b* front plate
15*c* side plate
15*d* side opening
16 blind
17 air filter
18 main-body air inlet
28 nozzle
28*a* blowing port
28*b* partitioning portion
28*c* vertical surface
28*d* guide path
28*e* tilted surface
28*f* overlapped portion
38 nozzle
38*a* blowing port
38*b* blowing port
40 wind receiving plate
40*a* air hole
40*b* tilted surface
40*c* side plate
50, 60, 70, 80, 85 wind receiving plate
50*a* storage portion
70*a*, 80*a* rotational shaft
91, 92, 93, 94, 95, 96, 97, 98, 99 hand drying apparatus

BEST MODE(S) FOR CARRYING OUT THE INVENTION

Exemplary embodiments of a hand drying apparatus according to the present invention will be explained in detail with reference to the accompanying drawings. The present invention is not limited to the embodiments.

First Embodiment

Figure 2:
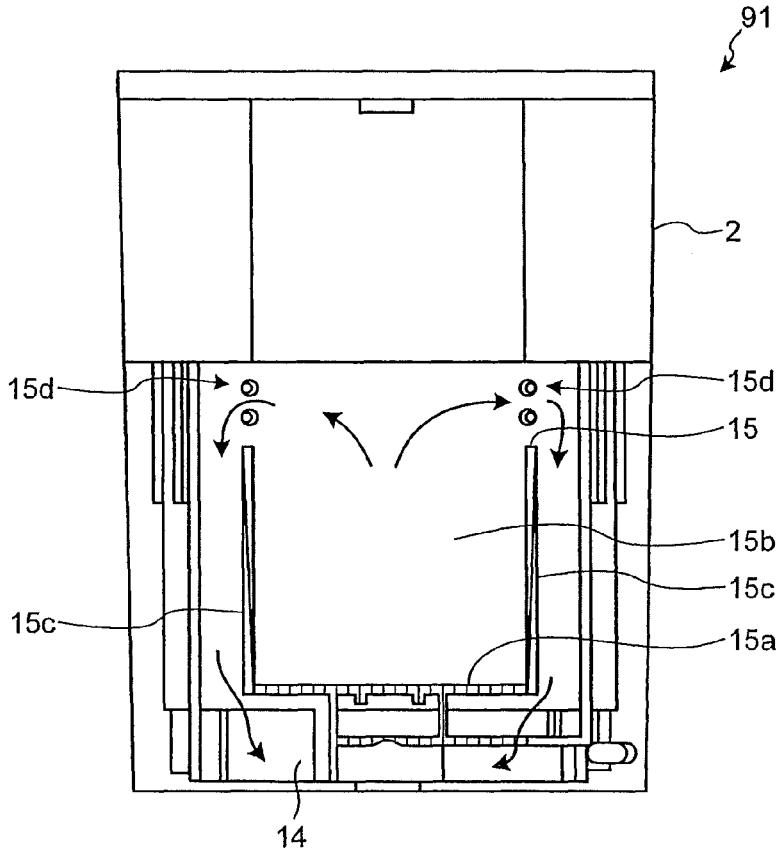
FIG. 2 is a partially broken rear view of the hand drying apparatus according to the first embodiment.
Figure 3:
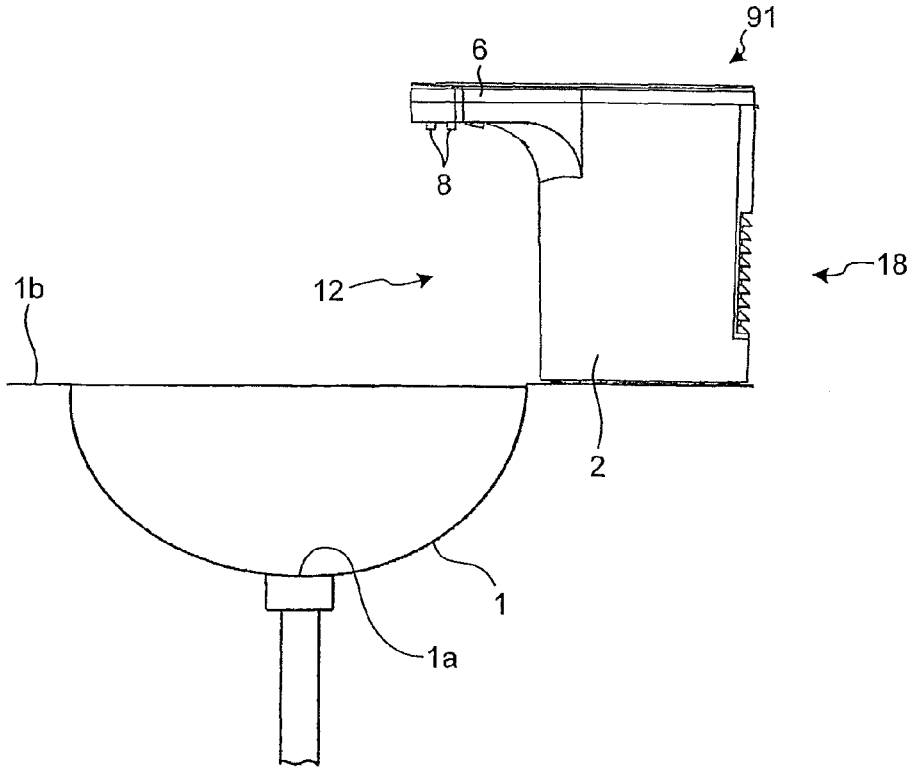
FIG. 3 is a partially broken side view of the hand drying apparatus according to the first embodiment for illustrating a situation where the hand drying apparatus is mounted on a side of a washbowl.
Figure 4:
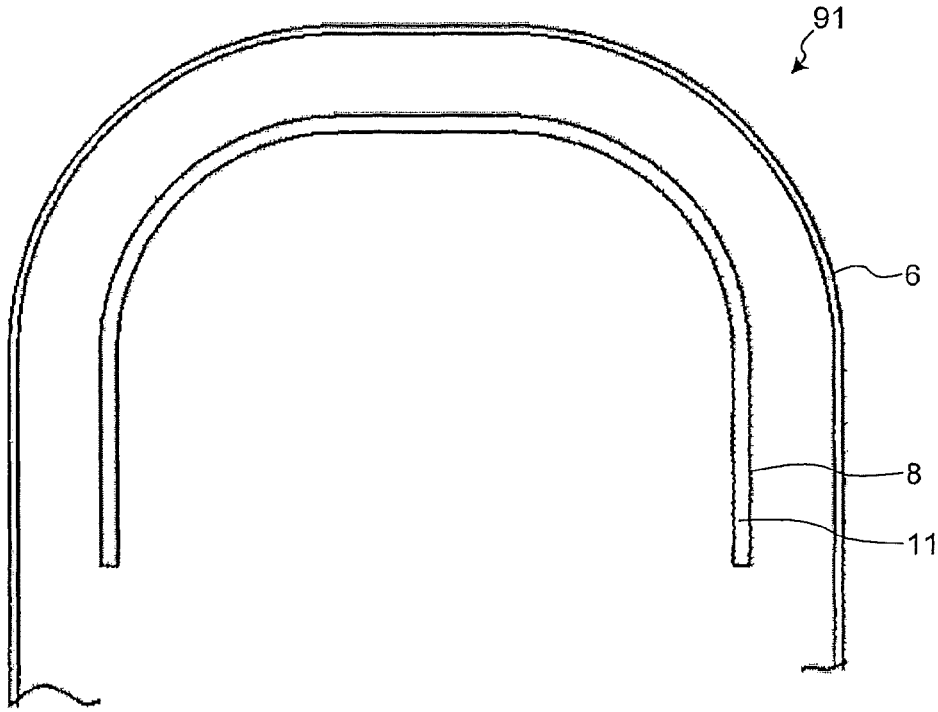
FIG. 4 is a bottom view of a protruded portion of the hand drying apparatus according to the first embodiment for illustrating an example of a nozzle of the hand drying apparatus.
Figure 5:
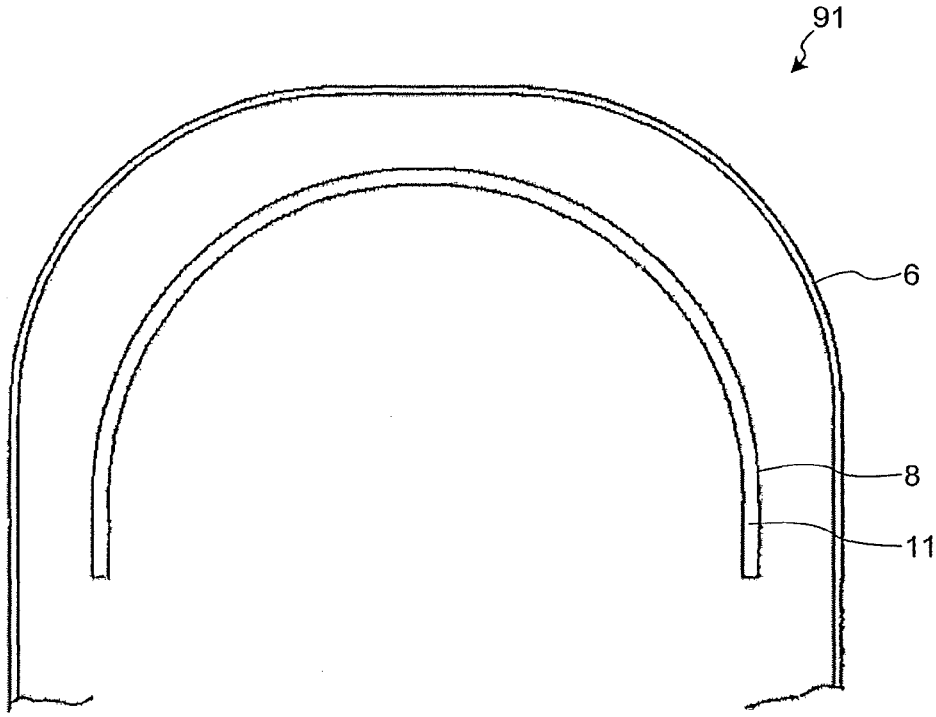
FIG. 5 is a bottom view of the protruded portion of the hand drying apparatus according to the first embodiment for illustrating a modified example of the nozzle of the hand drying apparatus.
Figure 6:
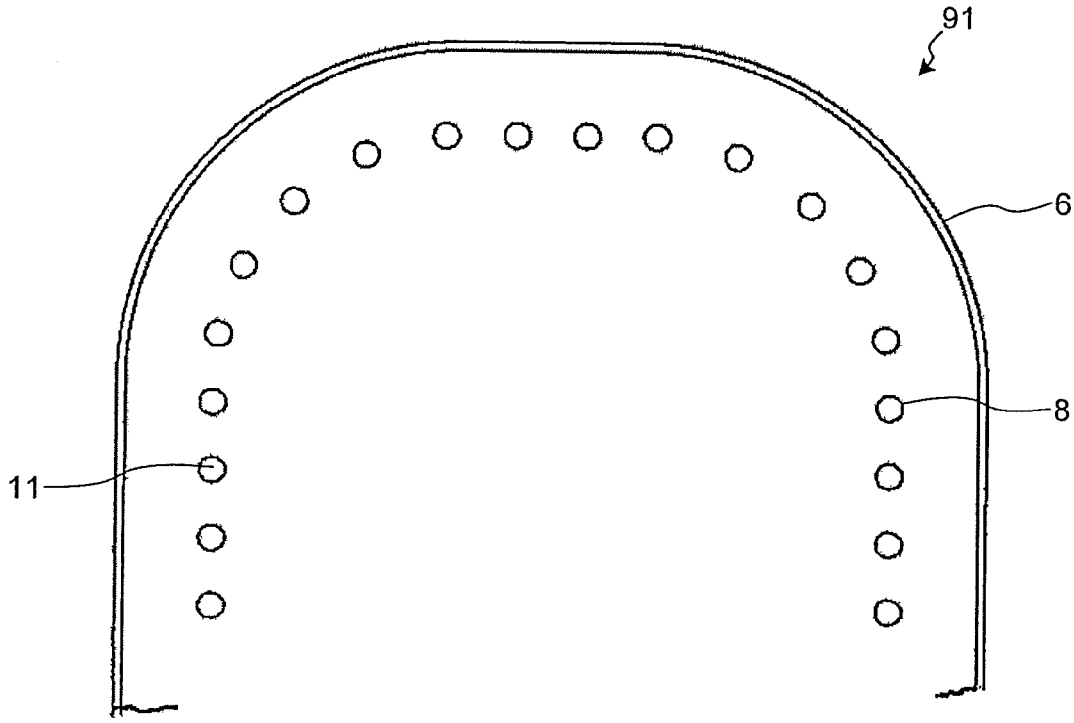
FIG. 6 is a bottom view of the protruded portion of the hand drying apparatus according to the first embodiment for illustrating another modified example of the nozzle of the hand drying apparatus.
Figure 7:
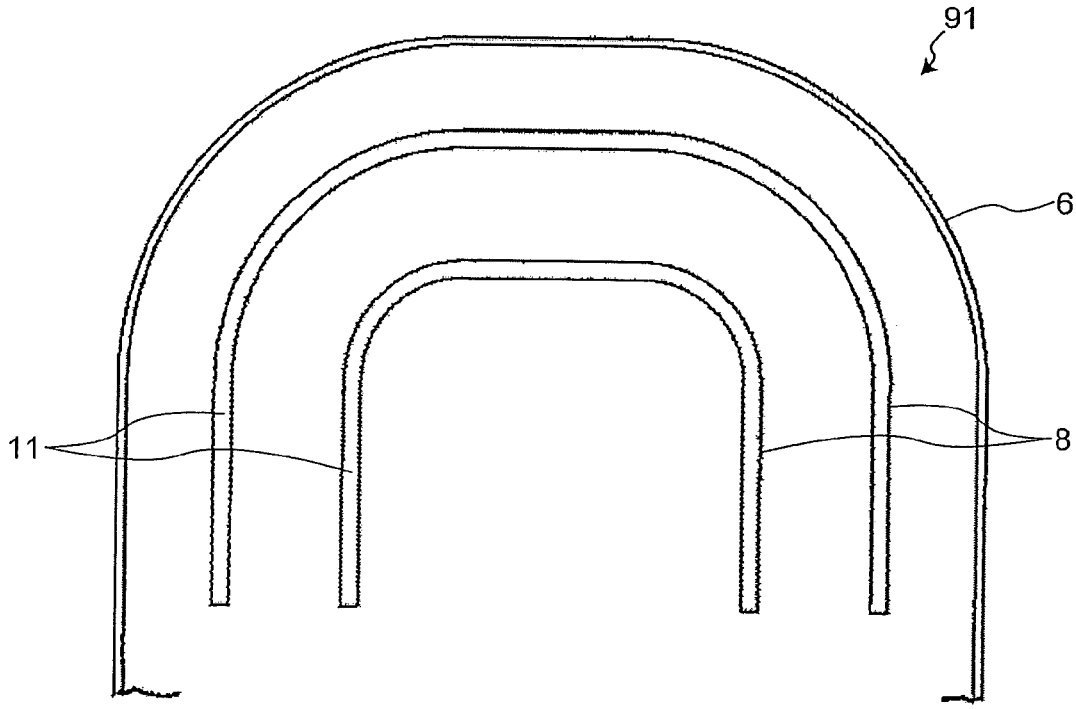
FIG. 7 is a bottom view of the protruded portion of the hand drying apparatus according to the first embodiment for illustrating another modified example of the nozzle of the hand drying apparatus.
Figure 8:
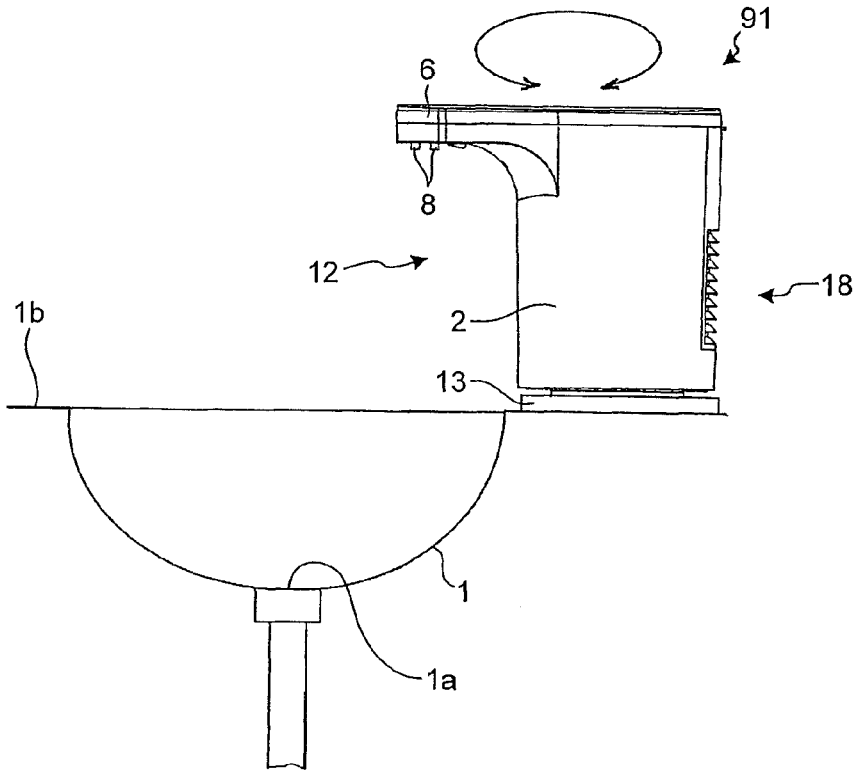
FIG. 8 is a partially broken side view of the hand drying apparatus according to the first embodiment for illustrating a situation where a modified example of the hand drying apparatus is mounted on the side of the washbowl.

FIG. 1 is a vertical cross section of a hand drying apparatus according to a first embodiment of the present invention; FIG. 2 is a partially broken rear view of the hand drying apparatus according to the first embodiment; FIG. 3 is a partially broken side view of the hand drying apparatus according to the first embodiment for illustrating a situation where the hand drying apparatus is mounted on a side of a washbowl; FIG. 4 is a bottom view of a protruded portion of the hand drying apparatus according to the first embodiment for illustrating an example of a nozzle of the hand drying apparatus; FIG. 5 is a bottom view of the protruded portion of the hand drying apparatus according to the first embodiment for illustrating a modified example of the nozzle of the hand drying apparatus; FIG. 6 is a bottom view of the protruded portion of the hand drying apparatus according to the first embodiment for illustrating another modified example of the nozzle of the hand drying apparatus; FIG. 7 is a bottom view of the protruded portion of the hand drying apparatus according to the first embodiment for illustrating another modified example of the nozzle of the hand drying apparatus; and FIG. 8 is a partially broken side view of the hand drying apparatus according to the first embodiment for illustrating a situation where a modified example of the hand drying apparatus is mounted on the side of the washbowl.

As shown in FIG. 3, a hand drying apparatus 91 according to the first embodiment is mounted on a side of a washbowl 1 of a washstand or a sink of a sink cabinet (the hand drying apparatus 91 can be mounted on a wall surface). A main body casing 2 is closed at its top and bottom, and is formed into a cylindrical shape, a hexagonal cylindrical shape, a half-cylindrical shape, or the like.

As shown in FIG. 1, a high-pressure airflow generator 3 is arranged in a lower portion of the main body casing 2. The high-pressure airflow generator 3 takes outside air from its lower portion, generates a high-pressure airflow, and then blows the generated high-pressure airflow. The high-pressure airflow generator 3 includes a motor 4 and a turbofan 5 that is rotated by the motor 4. The high-pressure airflow generated by the turbofan 5 is blown in the radial direction through a blowing port around the motor 4.

A protruded portion 6 is protruded from an upper portion of the main body casing 2 in a lateral direction as a protruded structure. An air path 7 is arranged inside the protruded portion 6 to pass the high-pressure airflow generated by the high-pressure airflow generator 3. An end of the air path 7 extends to an end of the protruded portion 6, and a nozzle 8 is arranged on the end of the air path 7. The nozzle 8 converts the high-pressure airflow into a high-speed airflow, and blows the high-speed airflow to a drying space (hand insertion space) 12 under the nozzle 8.

The high-speed airflow blown from the nozzle 8 has kinetic energy to blow water off user's hands that are put in the drying space 12. A heater 10 is arranged in the air path 7 to heat the high-pressure airflow. In addition, a sensor 9 is arranged in the protruded portion 6, and is located closer to the rear side of the main body casing 2 than the nozzle 8 is. The sensor 9 senses the presence of the hands.

Air flows through an air path leading from the outside of the main body casing 2 to an air inlet 14 of the high-pressure airflow generator 3 such that outside air taken through a main-body air inlet 18 opened on the rear side of the main body casing 2 is caused to flow upward and then downward by a trap 15 (see FIG. 2), flow in the circumferential direction, and is then taken into the air inlet 14 opened downward in the high-pressure airflow generator 3. This air path prevents water contained in the air taken by the hand drying apparatus 91 from entering the high-pressure airflow generator 3 when the hand drying apparatus 91 is used around the washstand.

As shown in FIG. 2, the trap 15 includes a bottom plate 15*a*, a front plate 15*b*, and side plates 15*c*. The trap 15 is arranged inside the main body casing 2 such that the trap 15 encloses the main-body air inlet 18. The trap 15 causes air taken through the main-body air inlet 18 to flow upward to an upper portion of the main-body air inlet 18, and then flow downward through an air path that leads from side openings 15*d* arranged in the upper portion of the main-body air inlet 18 to a lower portion of the main body casing 2.

A blind 16 for concealing the inside from view and an air filter 17 are arranged in the main-body air inlet 18. An HEPA filter or a sterilization filter can be used instead of the air filter 17. Alternatively, an HEPA filter or a sterilization filter can be arranged downstream of the air filter 17.

The nozzle 8 according to the first embodiment includes a blowing port 11 that is formed in a slit or a series of holes. The high-speed airflow is blown from the nozzle 8 on the lower surface of the protruded portion 6 downward to the drying space 12 in a line shape such that the front side (the front portion) and the both sides (the both side portions) of the drying space 12 are enclosed by the high-speed airflow.

In a case where the blowing port 11 is formed in a slit shape, slits of the blowing ports 11 in two rows are spaced at a pitch of about 30 mm, so that the high-speed airflow is easily affected by surrounding air, and the high-speed airflow quickly attenuates. Thus, it is possible to reduce scattering of water in the washbowl 1 having a hemisphere surface.

The drying space 12 has an entrance width, a height (each of the width and the height is about 100 mm to 200 mm), and a depth (about 65 mm to 150 mm) such that a user can put hands in the drying space 12 without feeling uncomfortable or restless, and can see the hands while freely putting the hands in and out of the drying space 12.

A planar shape (a cross-sectional shape) of the high-speed airflow blown to the drying space 12 under the protruded portion 6 such that the front side and the both sides of the drying space 12 are enclosed by the high-speed airflow is an arc shape (nonlinear shape) as a whole (see FIGS. 4 to 7). Specifically, the blowing port 11 of the nozzle 8 is formed into an arc shape corresponding to a planar profile of the substantially semicircular-shaped protruded portion 6. The nozzle 8 can be arranged in one row as shown in FIGS. 4 to 6, or can be arranged in a plurality of (two) rows as shown in FIG. 7. If the nozzle 8 is arranged in a plurality of rows, an area of the high-speed airflow to be in contact with the hands is increased, and therefore water can be blown off the hands with a higher efficiency.

In addition, as shown in FIG. 8, the main body casing 2 is rotatably mounded on a stand 13, and the protruded portion 6 is moved to a direction such that the user can easily put the hands in and out of the drying space 12, so that the user can operate the hand drying apparatus 91 in an easier manner. The stand 13 is configured such that a top plate on which the main body casing 2 is mounted is rotatably connected to a bottom plate that is mounted on the washstand, or the like, via a vertical shaft.

When the user puts the hands in the drying space 12 of the hand drying apparatus 91 according to the first embodiment, the sensor 9 senses the presence of the hands, and each of the high-pressure airflow generator 3 and the heater 10 starts its operation. The high-pressure airflow in the air path 7 is heated by the heater 10, and is then blown from the nozzle 8 to the drying space 12 as the high-speed airflow.

The high-speed airflow is blown from the protruded portion 6 downward to the drying space 12 such that the front side and the both sides of the drying space 12 are enclosed by the high-speed airflow. With this configuration, if the user puts the hands in and out of the drying space 12 in any directions, i.e., the user puts the hands through the front side of the drying space 12, diagonally through the front side, through the lateral side of the drying space 12, or diagonally through the lateral side, the hands cross the high-speed airflow at a substantially right angle. Thus, it is possible to improve the drying efficiency, and to reduce energy loss. The water removed from the hands by the high-speed airflow is blown off to the washbowl 1 or the sink, and then is drained off through an existing drain.

Second Embodiment

Figure 9:
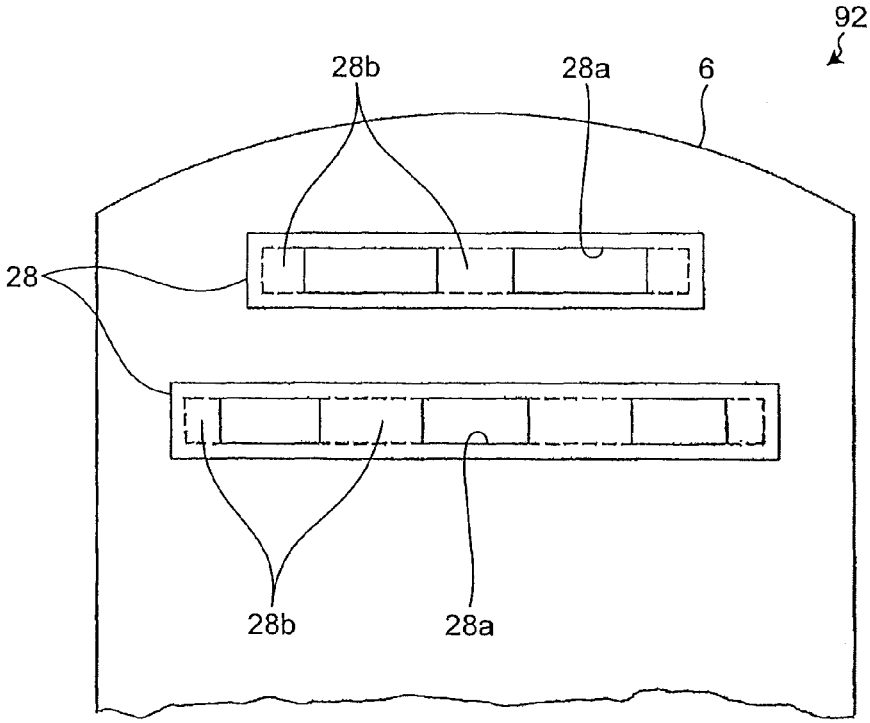
FIG. 9 is a bottom view of a protruded portion of a hand drying apparatus according to a second embodiment of the present invention for illustrating a nozzle of the hand drying apparatus.
Figure 10:
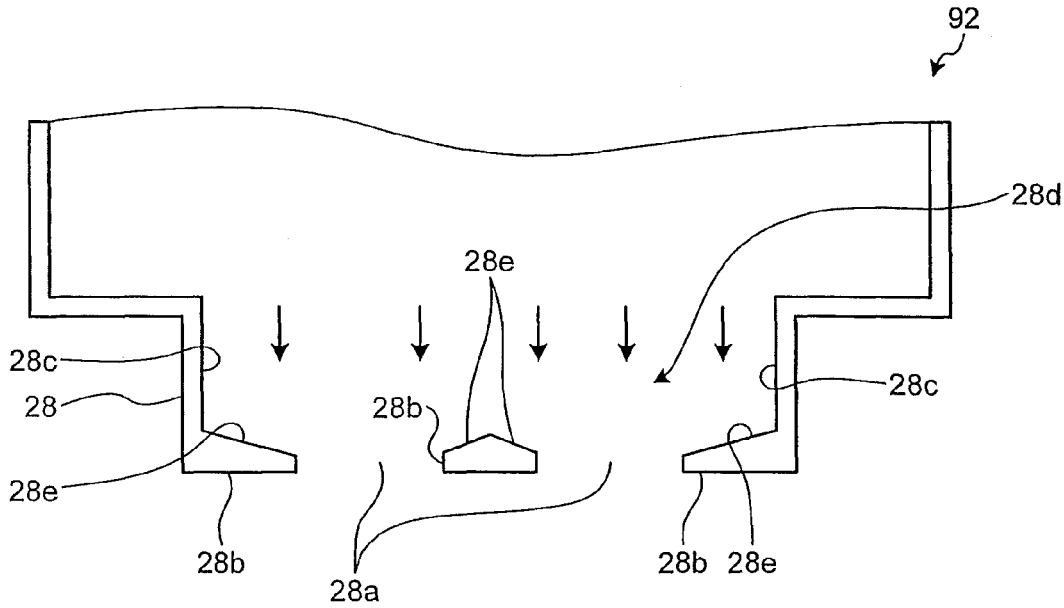
FIG. 10 is a cross section of the nozzle according to the second embodiment.
Figure 11:
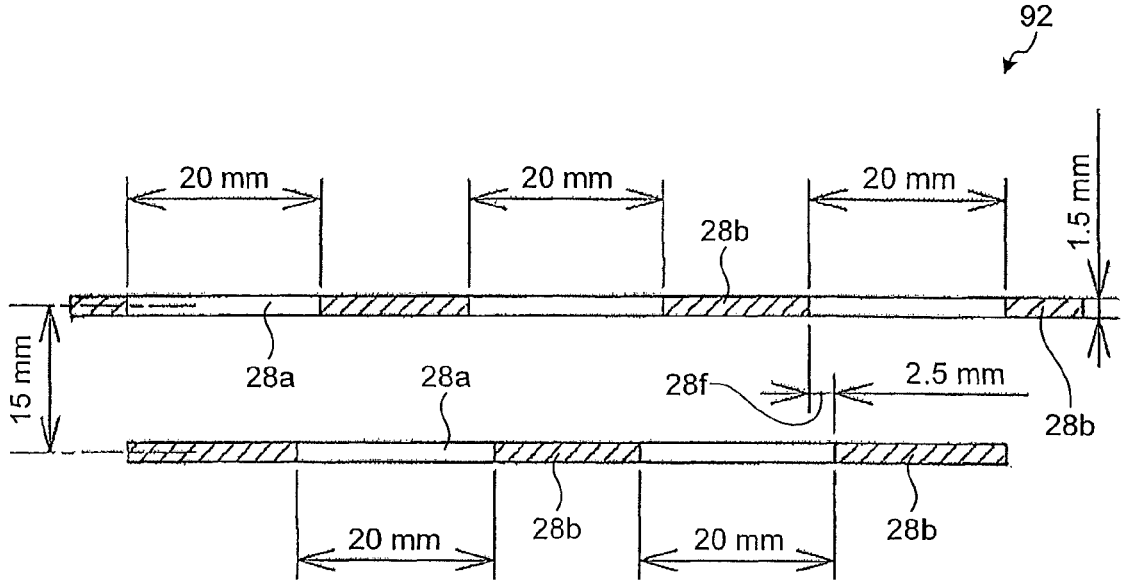
FIG. 11 is a diagram for illustrating arrangement of blowing ports of the nozzle according to the second embodiment.
Figure 12:
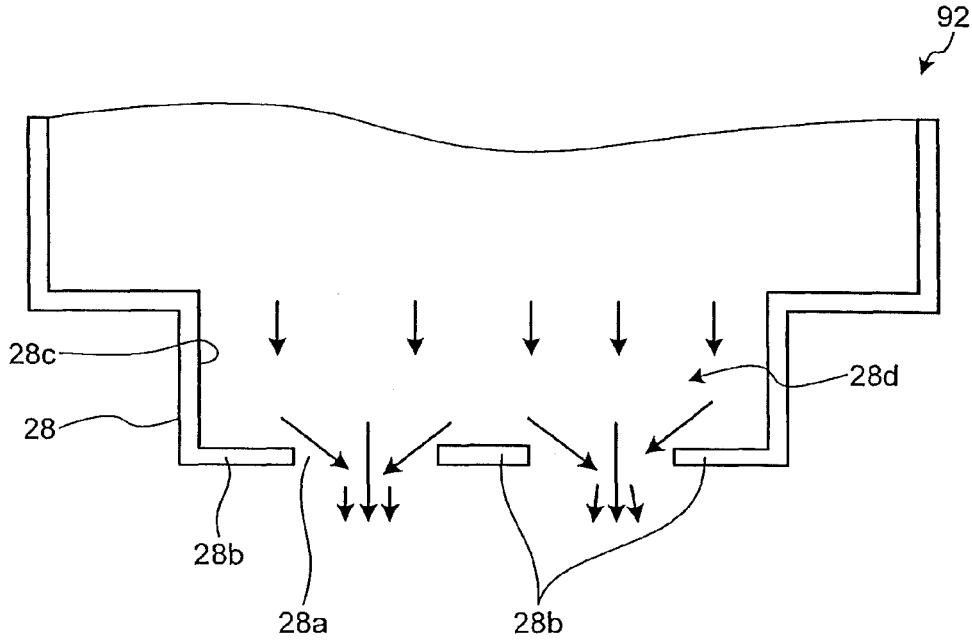
FIG. 12 is a cross section of a modified example of the nozzle according to the second embodiment.

FIG. 9 is a bottom view of a protruded portion of a hand drying apparatus according to a second embodiment of the present invention for illustrating a nozzle of the hand drying apparatus; FIG. 10 is a cross section of the nozzle of the hand drying apparatus according to the second embodiment; FIG. 11 is a diagram for illustrating arrangement of blowing ports of the nozzle of the hand drying apparatus according to the second embodiment; and FIG. 12 is a cross section of a modified example of the nozzle of the hand drying apparatus according to the second embodiment.

A hand drying apparatus 92 according to the second embodiment is different from the hand drying apparatus 91 according to the first embodiment only in the configuration of the nozzle. Therefore, the nozzle according to the second embodiment will be explained with reference to FIGS. 9 to 12, and an explanation on the other parts will be omitted.

A nozzles 28 are arranged in front and rear rows on the end of the air path 7 shown in FIG. 1 to convert the high-pressure airflow into the high-speed airflow. The nozzles 28 in the front row and the rear row are spaced at a pitch of 5 mm to 20 mm. As shown in FIGS. 9 and 10, a blowing port 28*a* of the nozzle 28 is formed into a slit shape. The line-shaped high-speed airflows are blown from the nozzles 28 on the protruded portion 6 downward to the front side of the drying space 12 (see FIG. 1) in the two lateral rows.

As shown in FIG. 10, opposing vertical surfaces 28*c*, 28*c* and a guide path 28*d* that leads to the blowing port 28*a* are formed inside the nozzle 28. The slit-shaped blowing port 28*a* is divided into two sub-blowing ports by partitioning portions 28*b* arranged at the both sides and the middle of the guide path 28*d*. The partitioning portions 28*b* cause a flow path to be sharply narrowed with respect to a distance between the parallel opposing vertical surfaces 28*c*, 28*c* in the guide path 28*d*.

Tilted surfaces 28*e* are formed on the inner sides of the partitioning portions 28*b*. The tilted surfaces 28*e* are tilted at a tilt angle of 15° to 45° downward toward the sub-blowing port of the blowing port 28*a*. The tilted surface 28*e* formed on the partitioning portion 28*b* at the middle has a shape like a mountain. As shown in FIGS. 9 and 11, the sub-blowing ports of the blowing ports 28*a* of the nozzles 28 in the front row and the rear row are arranged in a zigzag pattern.

The nozzle 28 according to the second embodiment is configured such that the high-speed airflow is blown from the protruded portion 6 downward to the front side of the drying space 12 in a lateral line shape. With this configuration, if the user puts the hands in and out of the drying space 12 on the front side of the hand drying apparatus 92, the hands cross the high-speed airflow at a right angle. Thus, it is possible to quickly dry the hands by blowing water off the wet hands.

The high-pressure airflow in the guide path 28*d* of the nozzle 28 flows toward the blowing port 28*a* along the vertical surfaces 28*c*, 28*c*. The flow path of the high-pressure airflow toward the blowing port 28*a* is sharply narrowed in the longitudinal direction of the blowing port 28*a*. Because the flow path of the high-pressure airflow is divided into two paths by the partitioning portions 28*b* located at the both sides and the middle of the guide path 28*d*, the high-pressure airflow at the middle of the guide path 28*d* combines the high-pressure airflow that flows from the side of the guide path 28*d* toward the middle, and the high-pressure airflow is narrowed at each of the sub-blowing ports of the blowing port 28*a*. Thus, the high-pressure airflow is converted into the high-speed airflow.

Because this high-speed airflow is formed by combining the high-pressure airflow at the middle of the guide path 28*d* and the high-pressure airflow that flows from the side of the guide path 28*d* toward the middle, an initial blowing speed of the high-speed airflow can be lowered. Moreover, the high-speed airflow is divided by the partitioning portion 28*b* at the middle in the longitudinal direction, and an area of the high-speed airflow to be in contact with surrounding air is made large, so that the high-speed airflow quickly attenuates. Furthermore, compared to a case where the partitioning portion 28*b* is arranged at a right angle to the vertical surface 28*c* as shown in FIG. 12, because the tilted surface 28*e* with a tilt angle of 15° to 45° is formed on the inner side of the partitioning portion 28*b*, separation of the high-pressure airflow at the corner is reduced, and occurrence of turbulence is prevented. Thus, the high-pressure airflow can be efficiently converted into the high-speed airflow.

If a hand insertion position is about 30 mm under the nozzle 28, and a wind speed of the high-speed airflow is set such that a wind speed near the hand insertion position is about 140 m/s that is sufficient to dry the hands, the wind speed attenuates to become about 24 m/s near a position 250 mm under the nozzle 8. The high-speed airflow at the wind speed of about 24 m/s does not have kinetic energy to blow water drops off the hands. For this reason, if the washbowl 1 or a water receiving unit is arranged near the position 250 mm under the nozzle 28, a water drop on the washbowl 1 or the water receiving unit is not splashed around the outside of the washbowl 1 or the water receiving unit by the high-speed airflow.

The blowing port 28*a* is divided by the partitioning portions 28*b* in the longitudinal direction, a size of the nozzle 28 is reduced in the longitudinal direction, and the plurality of the blowing ports 28*a* is arranged in the nozzle 28, so that the nozzle 28 can be reduced in size and the hand drying apparatus 92 can be compact. Furthermore, because the sub-blowing ports of the blowing ports 28*a* are arranged in a zigzag pattern, an area of the high-speed airflow to be in contact with surrounding air is made larger, and an effect of attenuation of the high-speed airflow is increased.

As shown in FIG. 11, if the sub-blowing ports of the blowing ports 28*a* are arranged in a zigzag pattern with an overlapped portion 28*f*, a thick airflow is generated locally at the overlapped portion 16. If the overlapped portion 28*f* is made larger, a maximum wind speed at which scattering of water drops is prevented becomes lower. However, the larger overlapped portion 28*f* can improve the drying efficiency with the same wind pressure.

Because the partitioning portions 28*b* are arranged in the nozzle 28, the wind speed is increased in a direction perpendicular to the longitudinal direction of the nozzle 28, i.e., in a depth direction. Thus, the hands can be effectively dried by rubbing the hands together other than keeping the hands open.

When the user puts the hands in the drying space 12 of the hand drying apparatus 92 according to the second embodiment, the sensor 9 senses the presence of the hands, and each of the high-pressure airflow generator 3 and the heater 10 starts its operation. The high-pressure airflow in the air path 7 is heated by the heater 10, and is then blown from the nozzle 28 to the drying space 12 as the high-speed airflow. The high-speed airflow is blown from the protruded portion 6 downward to the front side of the drying space 12. Water removed from the hands by the high-speed airflow is drained off from the washbowl 1 through the existing drain.

Third Embodiment

Figure 13:
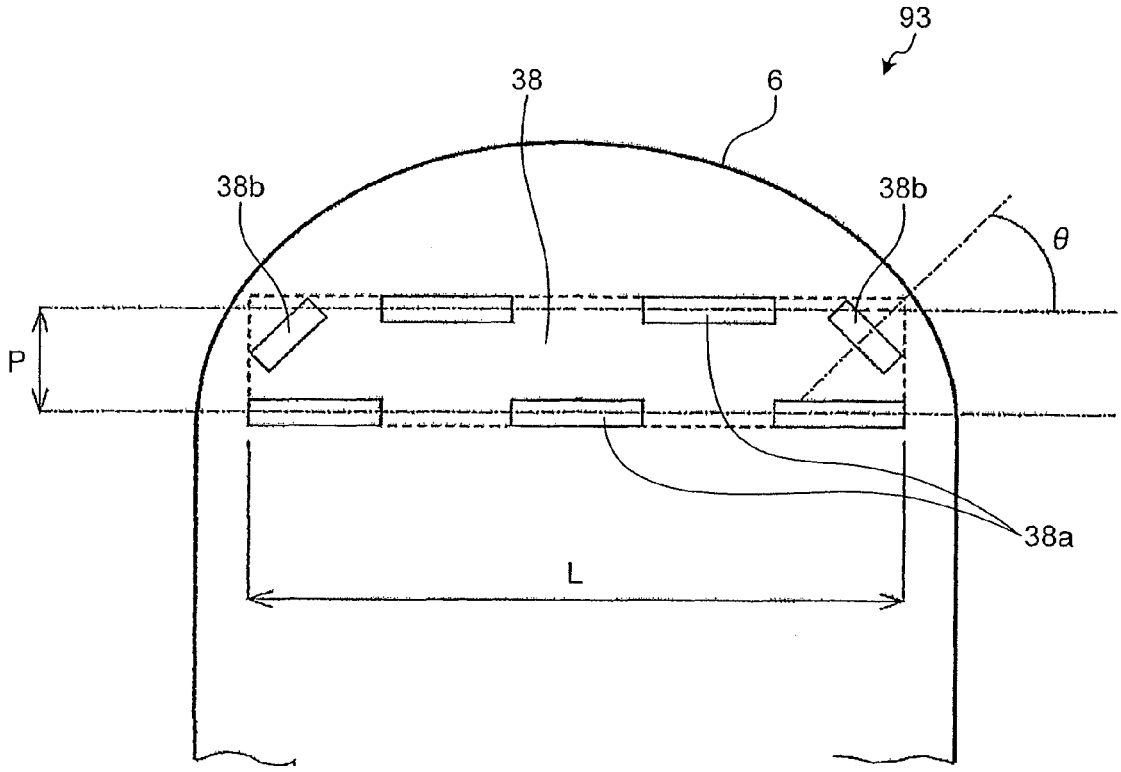
FIG. 13 is a bottom view of the protruded portion of a hand drying apparatus according to a third embodiment of the present invention for illustrating blowing ports of a nozzle of the hand drying apparatus.
Figure 14:
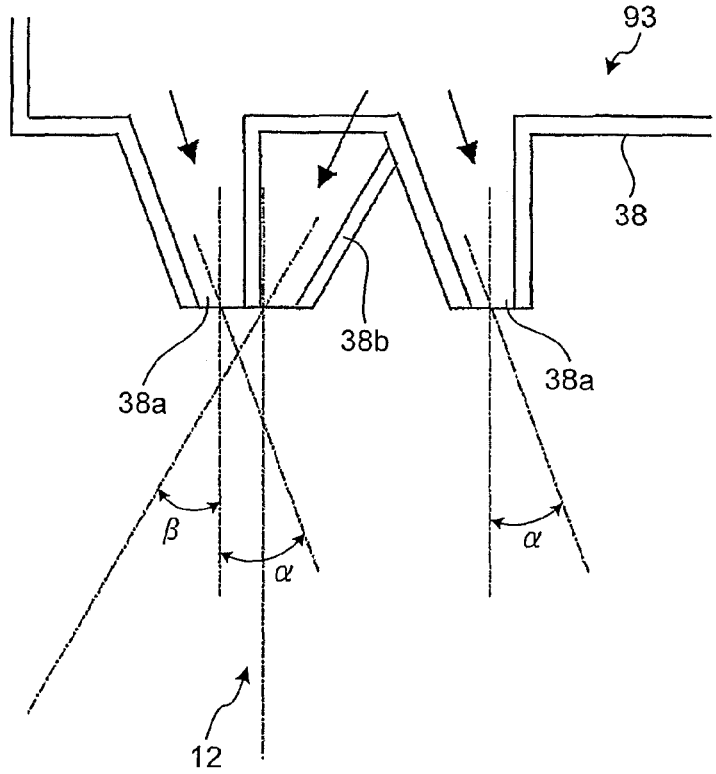
FIG. 14 is a vertical cross section of the nozzle according to the third embodiment.
Figure 15:
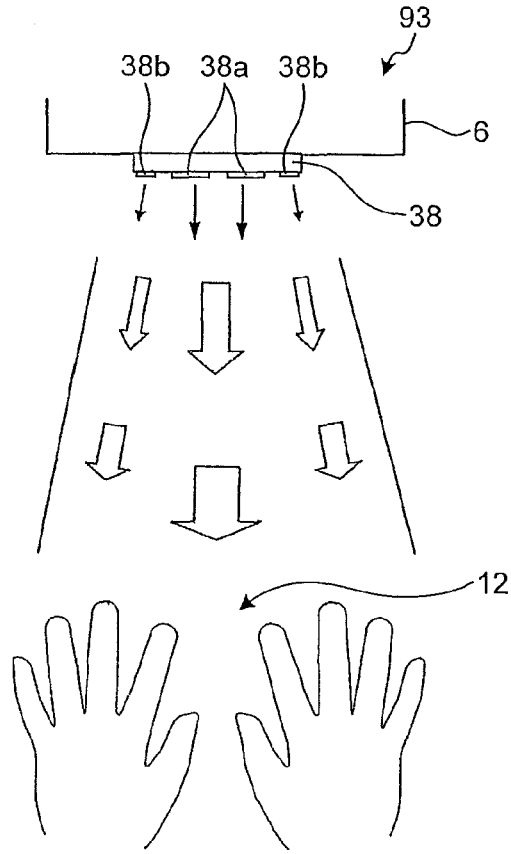
FIG. 15 is a front view of the hand drying apparatus according to the third embodiment for illustrating a high-speed airflow blown from the nozzle.
Figure 16:
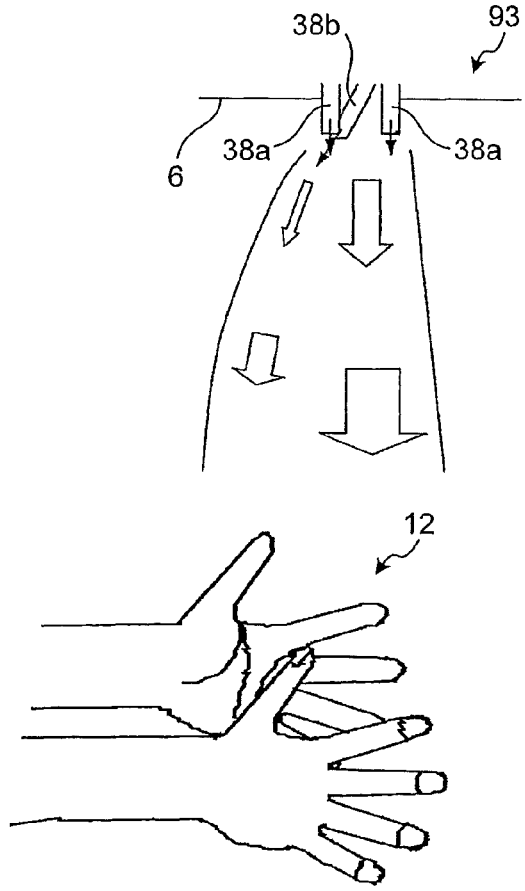
FIG. 16 is a side view of the hand drying apparatus according to the third embodiment for illustrating a high-speed airflow blown from the nozzle.

FIG. 13 is a bottom view of the protruded portion of a hand drying apparatus according to a third embodiment of the present invention for illustrating blowing ports of a nozzle of the hand drying apparatus; FIG. 14 is a vertical cross section of the nozzle according to the third embodiment; FIG. 15 is a front view of the hand drying apparatus according to the third embodiment for illustrating a high-speed airflow blown from the nozzle; and FIG. 16 is a side view of the hand drying apparatus according to the third embodiment for illustrating a high-speed airflow blown from the nozzle.

A hand drying apparatus 93 according to the third embodiment is different from the hand drying apparatus 91 according to the first embodiment only in the configuration of the nozzle. Therefore, the nozzle according to the third embodiment will be explained with reference to FIGS. 13 to 16, and an explanation on the other parts will be omitted.

As shown in FIG. 13, a nozzle 38 according to the third embodiment is arranged on the front of the protruded portion 6 such that the nozzle 38 extends across the full width of the air path 7. Blowing ports 38*a* of the nozzle 38 are arranged in a front row and a rear row in a long, narrow ellipse, a series of holes, or a slit shape as shown in FIG. 13. The blowing ports 38*a* in the front row is arranged parallel to the blowing ports 38*a* in the rear row with a pitch P of 10 mm to 20 mm in the front and back direction.

Each of the blowing ports 38*a* is formed to have a length of 15 mm to 20 mm in the lateral direction and a width of 1 mm to 2 mm in the front and back direction. The blowing ports 38*a* are arranged at a pitch of 10 mm to 20 mm in the lateral direction. Blowing ports 38*b* on both sides of the front row are obliquely arranged at an oblique angle θ of 30° to 60° between a lateral line direction of the front row and a normal of the blowing port 38*b*, so that the outer sides of the blowing ports 38*b* are located close to a lateral line direction of the rear row than to the lateral line direction of the front row. The three blowing ports 38*a* in the rear row is arranged in a zigzag pattern with respect to the two blowing ports 38*a* at the middle of the front row.

As shown in FIG. 14, the blowing ports 38*b* on the both sides of the front row are tilted forward at a blowing angle β of 30° with respect to a longitudinal direction. As shown in FIG. 13, the two blowing ports 38*a* in the front row and the three blowing ports 38*a* in the rear row are arranged within a rectangle area defined by L(70 mm to 100 mm)×P(10+1.3 mm to 20+1.3 mm). Furthermore, as shown in FIG. 14, the two blowing ports 38*a* in the front row and the three blowing ports 38*a* in the rear row are tilted backward at a blowing angle α of 0 to 20° with respect to the longitudinal direction.

The blowing angles α and β of the blowing ports 38*a* and 38*b* with respect to the longitudinal direction can be set by tilting the protruded portion 6 with respect to a lateral direction, or tilting the nozzle 38 with respect to the protruded portion 6.

In the nozzle 38 according to the third embodiment, the high-speed airflow is blown downward from the front of the protruded portion 6 in a line shape across a substantially full width of the protruded portion 6 at a flow speed of 130 m/s to 150 m/s. Each of the high-speed airflows blown from the blowing ports 38*a* in the front and rear rows in a diagonally backward and downward direction are increased in the widths in a substantially oblong shape while interacting with the surrounding air, and then the high-speed airflows are joined together to be one airflow, so that the high-speed airflow having a wide width in the front and back direction is obtained.

Because an area of this high-speed airflow to be in contact with the surrounding air is made large, the high-speed airflow quickly attenuates. For example, if the washbowl 1 or the water receiving unit is arranged near a position 250 mm from the blowing ports 38*a*, water drops on the washbowl 1 or the water receiving unit is not blown off by the high-speed airflow, or splashed around the outside of the washbowl 1 or the water receiving unit.

The high-speed airflows blown from the blowing ports 38*b* in a diagonally forward direction do not interfere with the high-speed airflows blown from the blowing ports 38*a* in the front and rear rows. The high-speed airflows blown from the blowing ports 38*b* are increased in the widths in a substantially oblong shape while interacting with the surrounding air. The high-speed airflows from the blowing ports 38*b* are blown in a diagonally forward direction to an area outside of the width of the substantially oblong-shaped high-speed airflow blown from the blowing ports 38*a* in the front and rear rows.

Therefore, as shown in FIGS. 15 and 16, an area of the high-speed airflow to be in contact with the hands put in the drying space 12 is increased on the front side and the left and right sides, and such a larger drying area improves the drying efficiency. Because the high-speed airflow is blown from the blowing port 38*a* in a diagonally backward and downward direction, the drying area can be made larger.

Even if a width of the nozzle 38 is small in the lateral direction, the drying space is made larger as described above, and the dying efficiency is improved. Therefore, a width dimension of the hand drying apparatus 93 can be reduced in the lateral direction, and the hand drying apparatus 93 can be compact. Water removed from the hands by the high-speed airflow is drained off from the washbowl 1 or the water receiving unit through the existing drain.

Fourth Embodiment

Figure 17:
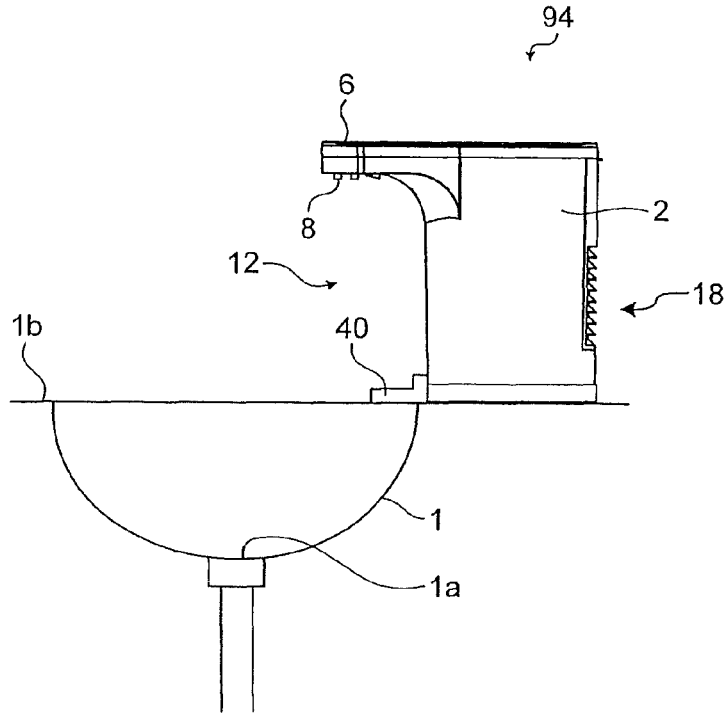
FIG. 17 is a partially broken side view of a hand drying apparatus according to a fourth embodiment of the present invention for illustrating a situation where the hand drying apparatus is mounted on a washstand.
Figure 18:
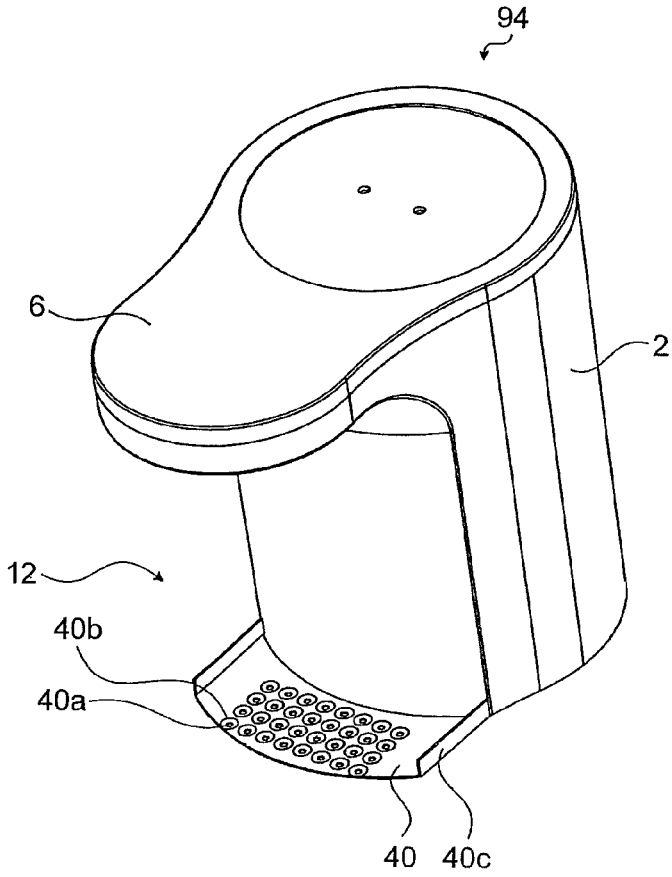
FIG. 18 is a perspective view of the hand drying apparatus according to the fourth embodiment.

FIG. 17 is a partially broken side view of a hand drying apparatus according to a fourth embodiment of the present invention for illustrating a situation where the hand drying apparatus is mounted on a washstand; and FIG. 18 is a perspective view of the hand drying apparatus according to the fourth embodiment.

A hand drying apparatus 94 according to the fourth embodiment is different from the hand drying apparatus 91 according to the first embodiment only in that the hand drying apparatus 94 includes a wind receiving plate 40 that is arrange on the front side of a lower portion of the main body casing 2 to receive the high-speed airflow from the nozzle 8. Therefore, the wind receiving plate 40 according to the fourth embodiment will be explained with reference to FIGS. 17 and 18, and an explanation on the other parts will be omitted.

As shown in FIGS. 17 and 18, the drying space 12 of the hand drying apparatus 94 according to the fourth embodiment is closed at its upper side by the protruded portion 6, at its bottom side by the wind receiving plate 40 arranged on the front side of the lower portion of the main body casing 2 to receive the high-speed airflow from the nozzle 8, and at its rear side by the main body casing 2. The front side and the both sides of the drying space 12 are open.

The drying space 12 has an entrance width, a height, and a depth such that a user can put hands in the drying space 12 without feeling uncomfortable or restless, and can see the hands while freely putting the hands in and out of the drying space 12. The height is set to about 100 mm to 250 mm, and the depth is set to about 65 mm to 150 mm.

As shown in FIG. 17, the hand drying apparatus 94 is mounted around the washbowl 1 of a washstand 1*b* (or around the sink of the kitchen counter). Water drops blown off the hands put in the drying space 12 are received by the wind receiving plate 40 under the drying space 12, are dropped down to the washbowl 1 by gravity, and are drained off through a drain 1*a* of the washbowl 1. Thus, a drain receptacle is not necessary in the hand drying apparatus 94, and cleaning of the drain receptacle does not need to be performed, resulting in improved maintenance performance.

Although a case where the hand drying apparatus 94 is mounted around the washbowl 1 of the washstand 1*b* is explained with reference to FIG. 17, a place in which the hand drying apparatus 94 is mounted is not limited to that, but the hand drying apparatus 94 can be fixed to a wall through an attachment plate. Moreover, it is possible that legs are attached to the hand drying apparatus 94, and the hand drying apparatus 94 stands on the washstand 1*b* with the legs in a stable manner.

The wind receiving plate 40 is arranged in a position to cross the axis line of the high-speed airflow blown from the nozzle 8 (a position opposed to the nozzle 8). The wind receiving plate 40 prevents water drops blown off the hands from being splashed into the washstand 1*b*, the washstand mirror, or the like. Furthermore, if the hand drying apparatus 94 operates in a situation where water is kept in the washbowl 1, or in a situation where water runs from the tap, the high-speed airflow from the nozzle 8 hits the wind receiving plate 40, and does not directly hit the washbowl 1, so that scattering of water in the washbowl 1 toward the washstand 1*b* or the floor is prevented.

The wind receiving plate 40 is provided with a plurality of air holes 40*a*. The high-speed airflow from the nozzle 8 hits the wind receiving plate 40, and passes through the air holes 40*a*, so that a speed of the high-speed airflow attenuates. In this manner, a speed at which the air hits the washbowl 1 after passing through the air hole 40*a* can be reduced, and scattering of water in the washbowl 1 can be prevented. If the air hole 40*a* is a circular hole with a small diameter, scattering of water can be prevented with high effectiveness. A shape of the air hole 40*a* is not limited to the circular hole, but can be a slit hole.

A tilted surface 40*b* is formed around the air hole 40*a* of the wind receiving plate 40 in a tapered manner. Water drops blown off the hands flow down from the tilted surface 40*b* through the air hole 40*a* in a smooth manner without remaining on the wind receiving plate 40. The wind receiving plate 40 can be laterally attached to the main body casing 2, or the wind receiving plate 40 can be attached to the main body casing 2 such that the wind receiving plate 40 is tilted downward in the forward direction. The water drops can flow down in a smooth manner if the wind receiving plate 40 is laterally arranged, or is tilted downward.

If the wind receiving plate 40 is made of a resin, and an antibacterial agent is applied to the wind receiving plate 40 by impregnation or coating, adhesion of dirt can be reduced, and bacterial growth can be lowered. In addition, the wind receiving plate 40 can be made of perforated metal that includes a plurality of circular holes with a small diameter.

As shown in FIG. 18, it is preferable that side plates 40*c* are arranged on the sides of the wind receiving plate 40. The side plates 40*c* prevent water drops blown off the hands from being splashed through the sides of the wind receiving plate 40. Thus, the washstand 1*b* or the floor does not get wet, the user does not feel uncomfortable about the splashed water, and cleanness is improved. Furthermore, the side plates 40*c* can increase strength of the wind receiving plate 40.

Fifth Embodiment

Figure 19:
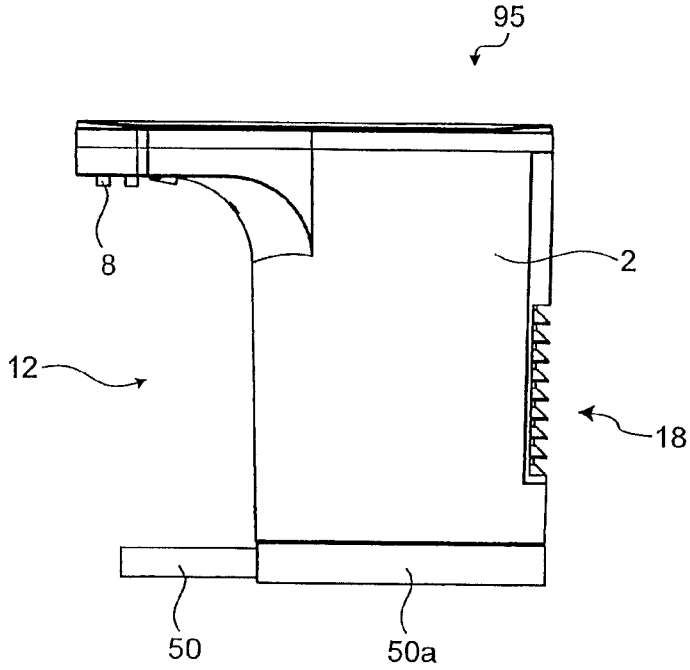
FIG. 19 is a side view of a hand drying apparatus according to a fifth embodiment of the present invention.

FIG. 19 is a side view of a hand drying apparatus according to a fifth embodiment of the present invention. A hand drying apparatus 95 according to the fifth embodiment is different from the hand drying apparatus 94 according to the fourth embodiment only in the installation configuration of a wind receiving plate 50 shown in FIG. 19. Therefore, the different part will be explained, and an explanation on the other parts will be omitted.

As shown in FIG. 19, the wind receiving plate 50 according to the fifth embodiment is mounted in a storage portion 50*a* arranged in the lower portion of the main body casing 2 in a retractable and extendable manner. The wind receiving plate 50 can be pulled out into the drying space 12 in a substantially lateral direction, and can be located in a position to cross the axis line of the high-speed airflow from the nozzle 8.

The wind receiving plate 50 prevents water drops blown off the hands from being splashed around the washstand 1*b*, the washstand mirror, or the like. Moreover, if the hand drying apparatus 95 operates in a situation where water is kept in the washbowl 1, or in a situation where water runs from the tap, the high-speed airflow from the nozzle 8 hits the wind receiving plate 50, and does not directly hit the washbowl 1, so that scattering of water in the washbowl 1 toward the washstand 1*b* or the floor is prevented. When the washbowl 1 is to be cleaned, the wind receiving plate 50 is retracted inside the storage portion 50*a*, so that the wind receiving plate 50 does not interfere with the cleaning operation.

Sixth Embodiment

Figure 20:
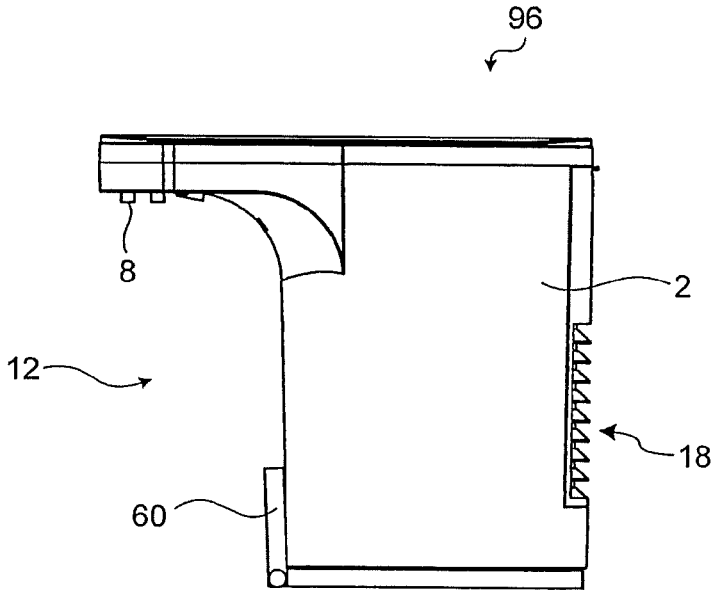
FIG. 20 is a side view of a hand drying apparatus according to a sixth embodiment of the present invention.

FIG. 20 is a side view of a hand drying apparatus according to a sixth embodiment of the present invention. A hand drying apparatus 96 according to the sixth embodiment is different from the hand drying apparatus 94 according to the fourth embodiment only in the installation configuration of a wind receiving plate 60 shown in FIG. 20. Therefore, the different part will be explained, and an explanation on the other parts will be omitted.

As shown in FIG. 20, the wind receiving plate 60 according to the sixth embodiment is arranged on the front side of the lower portion of the main body casing 2 such that the wind receiving plate 60 is rotatable upward and downward. The wind receiving plate 60 is rotatable between a substantially horizontal position to cross the axis line of the high-speed airflow from the nozzle 8 in the drying space 12 and an upward position as shown in FIG. 20.

When the wind receiving plate 60 is in the substantially horizontal position, the wind receiving plate 60 prevents water drops blown off the hands from being splashed around the washstand 1*b*, the washstand mirror, or the like. Moreover, if the hand drying apparatus 96 operates in a situation where water is kept in the washbowl 1, or water runs from the tap, the high-speed airflow from the nozzle 8 hits the wind receiving plate 60, and does not directly hit the washbowl 1, so that scattering of water in the washbowl 1 toward the washstand 1*b* or the floor is prevented. When the washbowl 1 is to be cleaned, the wind receiving plate 60 is rotated to the upward position, so that the wind receiving plate 60 does not interfere with the cleaning operation.

Seventh Embodiment

Figure 21:
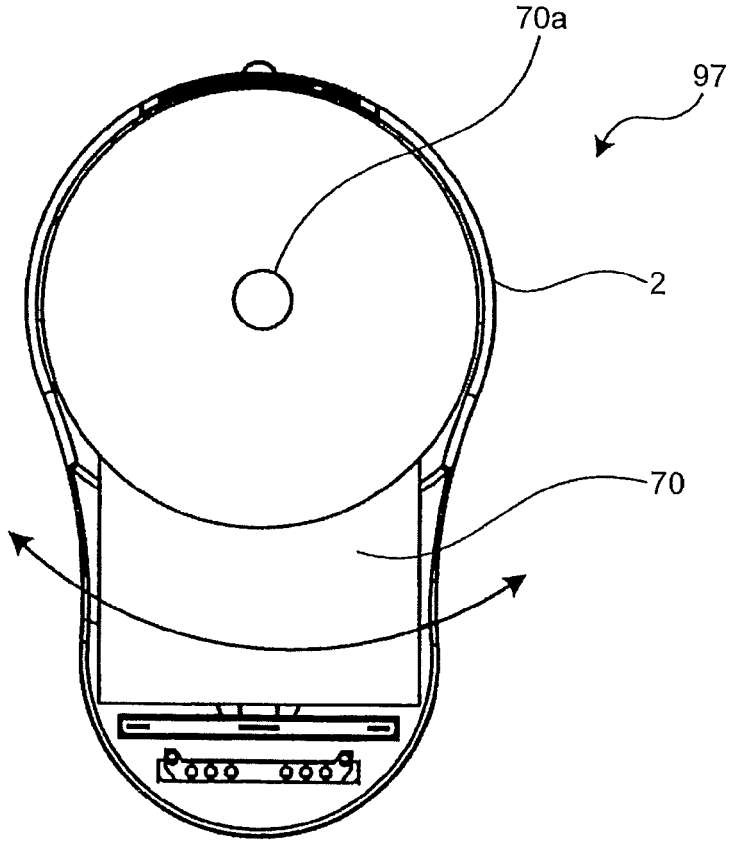
FIG. 21 is a bottom view of a hand drying apparatus according to a seventh embodiment of the present invention.

FIG. 21 is a bottom view of a hand drying apparatus according to a seventh embodiment of the present invention. A hand drying apparatus 97 according to the seventh embodiment is different from the hand drying apparatus 94 according to the fourth embodiment only in the installation configuration of a wind receiving plate 70 shown in FIG. 21. Therefore, the different part will be explained, and an explanation on the other parts will be omitted.

As shown in FIG. 21, the wind receiving plate 70 according to the seventh embodiment is attached to the main body casing 2 such that the wind receiving plate 70 can be rotated in the lateral direction around a rotational shaft 70*a* arranged in the center of the bottom of the main body casing 1. The wind receiving plate 70 can be rotated between a position to cross the axis line of the high-speed airflow from the nozzle 8 in the drying space 12 and a position outside of the washbowl 1. In this manner, the wind receiving plate 70 can be located in an appropriate position for the user or installation personnel.

Eighth Embodiment

Figure 22:
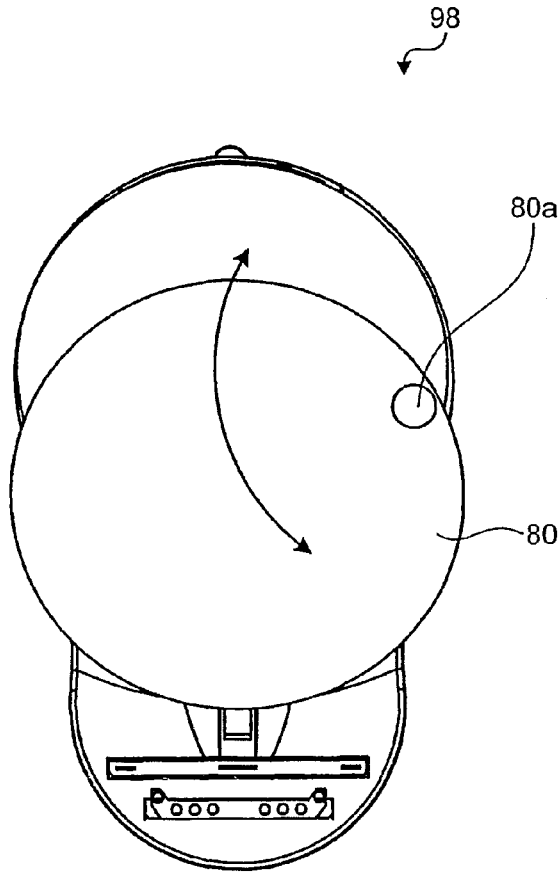
FIG. 22 is a bottom view of a hand drying apparatus according to an eighth embodiment of the present invention.

FIG. 22 is a bottom view of a hand drying apparatus according to an eighth embodiment of the present invention. A hand drying apparatus 98 according to the eighth embodiment is different from the hand drying apparatus 94 according to the fourth embodiment only in the installation configuration of a wind receiving plate 80 shown in FIG. 22. Therefore, the different part will be explained, and an explanation on the other parts will be omitted.

As shown in FIG. 22, the wind receiving plate 80 according to the eighth embodiment is attached to the main body casing 2 such that the wind receiving plate 80 can be rotated in the front and back direction (in the lateral direction) around a rotational shaft 80*a* arranged on the outer circumference of the bottom of the main body casing 2. The wind receiving plate 80 can be rotated between a position to cross the axis line of the high-speed airflow from the nozzle 8 in the drying space 12 and a position outside of the washbowl 1, i.e., a position under the main body casing 2. When the washbowl 1 is to be cleaned, the wind receiving plate 80 is retracted to the position under the main body casing 2, so that the wind receiving plate 80 does not interfere with the cleaning operation.

Ninth Embodiment

Figure 23:
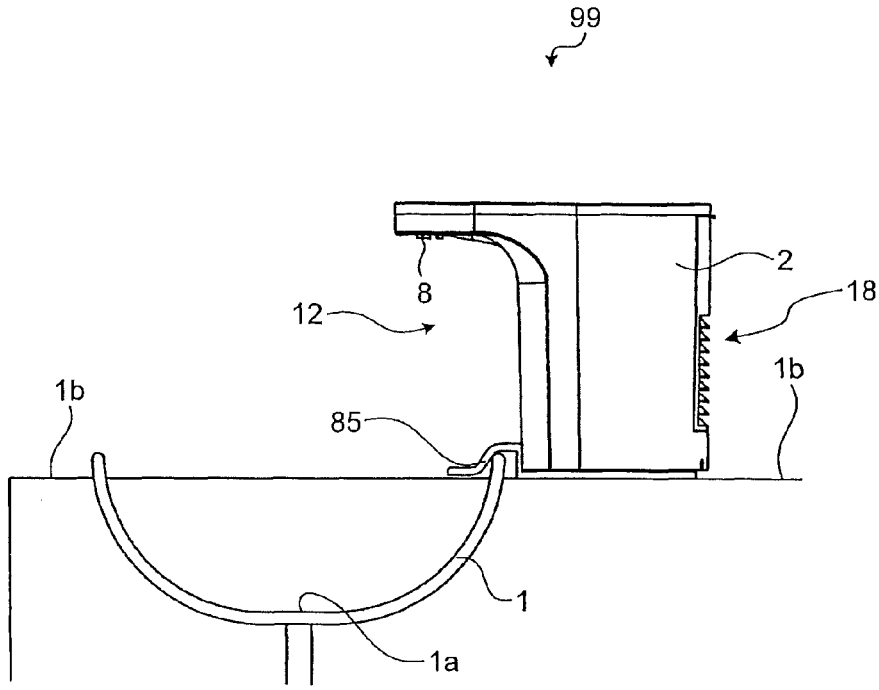
FIG. 23 is a partially broken side view of a hand drying apparatus according to a ninth embodiment of the present invention.

FIG. 23 is a partially broken side view of a hand drying apparatus according to a ninth embodiment of the present invention. A hand drying apparatus 99 according to the ninth embodiment is different from the hand drying apparatus 94 in the fourth embodiment only in the installation configuration of a wind receiving plate 85 shown in FIG. 23. Therefore, the different part will be explained, and an explanation on the other parts will be omitted.

As shown in FIG. 23, the wind receiving plate 85 according to the ninth embodiment is configured to correspond to the washbowl 1 having its outer edge protruded from the upper surface of the washstand 1*b*. An attachment position of the wind receiving plate 85 to the front side of the lower portion of the main body casing 2 is located higher than a protruded portion of the outer edge of the washbowl 1.

Although it is explained in the fourth embodiment to the ninth embodiment that the hand drying apparatuses 94 to 99 are mounted on the washstand 1*b*, installation locations of the hand drying apparatuses 94 to 99 are not limited to that, but can be mounted on a wall in abutment with the washstand 1*b*. Furthermore, it can be configured such that the wind receiving plates 40 to 85 are detached from the main body casing 2. With this configuration, the wind receiving plates 40 to 85 are cleaned to remove dirt due to water drops blown off the hands in a state that the wind receiving plates 40 to 85 are detached from the main body casing 2.

INDUSTRIAL APPLICABILITY

As described above, the hand drying apparatus according to the present invention is suitable for a hand drying apparatus to be installed in a hand-washing place or a rest room in an office building, a hotel, a family restaurant, amusement facilities, a general supermarket, a food/medical/cosmetic/other general factory, a school, or public facilities.

The invention claimed is:

1. A hand drying apparatus comprising:

a high-pressure airflow generator that takes air through an air inlet arranged at a lower portion of the high-pressure airflow generator and generates a high-pressure airflow;

a main body casing in which the high-pressure airflow generator is accommodated;

a first air path that is protruded from the main body casing and that allows passage of air from the high-pressure airflow generator; and a nozzle that is located in a position ahead of the main body casing in a direction of the first air path and that blows air from the first air path toward a front portion and side portions of a drying space under the first air path, wherein the main body casing includes a main-body air inlet through which outside air is taken, and a second air path that causes air from the main-body air inlet to flow upward and then downward to a level where the air inlet of the high-pressure airflow generator is located.

2. The hand drying apparatus according to claim 1, wherein the nozzle includes a nonlinear portion.

3. The hand drying apparatus according to claim 1, wherein the nozzle is arranged in one row or a plurality of rows and changes the air from the first air path to a high-speed airflow in a line shape.

4. A hand drying apparatus comprising:

a high-pressure airflow generator that takes air through an air inlet arranged at a lower portion of the high-pressure airflow generator and generates a high-pressure airflow;

a main body casing in which the high-pressure airflow generator is accommodated;

a first air path that is protruded from the main body casing and that allows passage of air from the high-pressure airflow generator; and a nozzle that is located in a position ahead of the main body casing in a direction of the first air path and that blows air from the first air path toward a drying space under the first air path, wherein the main body casing includes a main-body air inlet through which outside air is taken, and a second air path that causes air from the main-body air inlet to flow upward and then downward to a level where the air inlet of the high-pressure airflow generator is located, and the nozzle is formed into slits arranged in a front row and a rear row in the direction of the first air path, and each of the slits is formed into a plurality of blowing ports divided by a partitioning portion and arranged in one row in a longitudinal direction of each of the slits.

5. The hand drying apparatus according to claim 4, wherein the partitioning portion includes a downward tilted surface on its inner side toward each of the blowing ports.

6. The hand drying apparatus according to claim 5, wherein a tilt angle of the tilted surface is set to 15 degrees to 45 degrees.

7. The hand drying apparatus according to claim 4, wherein the blowing ports in the front and the rear rows are arranged in a zigzag pattern.

8. A hand drying apparatus comprising:

a high-pressure airflow generator that takes air through an air inlet arranged at a lower portion of the high-pressure airflow generator and generates a high-pressure airflow;

a main body casing in which the high-pressure airflow generator is accommodated;

a first air path that is protruded from the main body casing and that allows passage of air from the high-pressure airflow generator; and a nozzle that is located in a position ahead of the main body casing in a direction of the first air path and that blows air from the first air path toward a drying space under the first air path, wherein the nozzle is formed into slits arranged in a front row and a rear row in the direction of the first air path, each of the slits is formed into a plurality of blowing ports divided and arranged in one row in a longitudinal direction of each of the slits, and the blowing ports on both sides of one of the slits in the front row located farther away from the main body casing in the direction of the first air path are arranged such that outer edges of the blowing ports on the both sides of the one of the slits in the front row are located close to one of the slits in the rear row.

9. The hand drying apparatus according to claim 8, wherein blowing directions of the blowing ports on the both sides of the one of the slits in the front row are tilted in a direction such that the blowing directions are located away from the main body casing with respect to a longitudinal direction.

10. The hand drying apparatus according to claim 8, wherein blowing directions of the blowing ports other than the blowing ports on the both sides of the one of the slits in the front row are tilted in a direction such that the blowing directions are located close to the main body casing with respect to a longitudinal direction.

11. The hand drying apparatus according to claim 8, wherein the blowing ports other than the blowing ports on the both sides of the one of the slits in the front row and the blowing ports of the one of the slits in the rear row are arranged in a zigzag pattern.

12. The hand drying apparatus according to claim 8, further comprising a wind receiving plate that is arranged on a front side of a lower portion of the main body casing such that the wind receiving plate is opposed to the blowing ports of the nozzle to receive the airflow from the nozzle.

13. The hand drying apparatus according to claim 12, wherein the wind receiving plate includes a plurality of air holes.

14. The hand drying apparatus according to claim 13, wherein a tilted surface is formed around each of the air holes in a tapered manner.

15. The hand drying apparatus according to claim 12, wherein the wind receiving plate is attached to the main body casing in a lateral direction.

16. The hand drying apparatus according to claim 12, wherein the wind receiving plate is attached to the main body casing such that the wind receiving plate is tilted downward in a forward direction.

17. The hand drying apparatus according to claim 12, wherein the wind receiving plate is retractable into the lower portion of the main body casing.

18. The hand drying apparatus according to claim 12, wherein the wind receiving plate is rotatable upward and downward between a substantially horizontal position and an upward position.

19. The hand drying apparatus according to claim 12, wherein the wind receiving plate is rotatable in a lateral direction around a shaft arranged on a bottom of the main body casing.

20. A hand drying apparatus comprising:

a high-pressure airflow generator that takes air through an air inlet arranged at a lower portion of the high-pressure airflow generator and generates a high-pressure airflow;

a main body casing in which the high-pressure airflow generator is accommodated;

a first air path that is protruded from the main body casing and that allows passage of air from the high-pressure airflow generator; and a nozzle that is located in a position ahead of the main body casing in a direction of the first air path and that blows air from the first air path toward a drying space under the first air path, wherein the main body casing includes a main-body air inlet through which outside air is taken, and a second air path that causes air from the main-body air inlet to flow upward and then downward to a level where the air inlet of the high-pressure airflow generator is located, the nozzle is formed into slits arranged in a front row and a rear row in the direction of the first air path, each of the slits is formed into a plurality of blowing ports divided and arranged in one row in a longitudinal direction of each of the slits, and the blowing ports on both sides of one of the slits in the front row located farther away from the main body casing in the direction of the first air path are arranged such that outer edges of the blowing ports on the both sides of the one of the slits in the front row are located close to one of the slits in the rear row.

21. The hand drying apparatus according to claim 20, wherein blowing directions of the blowing ports on the both sides of the one of the slits in the front row are tilted in a direction such that the blowing directions are located away from the main body casing with respect to a longitudinal direction.

22. The hand drying apparatus according to claim 20, wherein blowing directions of the blowing ports other than the blowing ports on the both sides of the one of the slits in the front row are tilted in a direction such that the blowing directions are located close to the main body casing with respect to a longitudinal direction.

23. The hand drying apparatus according to claim 20, wherein the blowing ports other than the blowing ports on the both sides of the one of the slits in the front row and the blowing ports of the one of the slits in the rear row are arranged in a zigzag pattern.

24. The hand drying apparatus according to claim 20, further comprising a wind receiving plate that is arranged on a front side of a lower portion of the main body casing such that the wind receiving plate is opposed to the blowing ports of the nozzle to receive the airflow from the nozzle.

25. The hand drying apparatus according to claim 24, wherein the wind receiving plate includes a plurality of air holes.

26. The hand drying apparatus according to claim 25, wherein a tilted surface is formed around each of the air holes in a tapered manner.

27. The hand drying apparatus according to claim 24, wherein the wind receiving plate is attached to the main body casing in a lateral direction.

28. The hand drying apparatus according to claim 24, wherein the wind receiving plate is attached to the main body casing such that the wind receiving plate is tilted downward in a forward direction.

29. The hand drying apparatus according to claim 24, wherein the wind receiving plate is retractable into the lower portion of the main body casing.

30. The hand drying apparatus according to claim 24, wherein the wind receiving plate is rotatable upward and downward between a substantially horizontal position and an upward position.

31. The hand drying apparatus according to claim 24, wherein the wind receiving plate is rotatable in a lateral direction around a shaft arranged on a bottom of the main body casing.

* * * * *